US007300295B2

(12) United States Patent
Kimura et al.

(10) Patent No.: US 7,300,295 B2
(45) Date of Patent: Nov. 27, 2007

(54) CONNECTOR WHICH CAN BE REDUCED IN OPERATING FORCE AND MINIATURIZED

(75) Inventors: Akira Kimura, Tokyo (JP); Keisuke Nakamura, Tokyo (JP); Takamitsu Wada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/515,289

(22) Filed: Sep. 1, 2006

(65) Prior Publication Data

US 2007/0054526 A1 Mar. 8, 2007

(30) Foreign Application Priority Data

Sep. 2, 2005 (JP) ..... 2005-254836

(51) Int. Cl.
*H01R 13/62* (2006.01)

(52) U.S. Cl. ..... 439/159; 439/63; 439/248

(58) Field of Classification Search ..... 439/159, 439/630, 289
See application file for complete search history.

(56) References Cited

U.S. PATENT DOCUMENTS 4,952,161 A * 8/1990 Komatsu ..... 439/155
5,548,484 A * 8/1996 Kantner ..... 361/737
5,737,185 A * 4/1998 Morrison et al. ..... 361/685
5,886,869 A * 3/1999 Fussell et al. ..... 361/685
6,030,238 A * 2/2000 Dong ..... 439/159
6,099,323 A * 8/2000 Ho et al. ..... 439/64
6,394,827 B2 * 5/2002 Nogami ..... 439/159
6,749,465 B1 * 6/2004 Huang et al. ..... 439/630
6,908,322 B1 * 6/2005 Bricaud et al. ..... 439/152
7,125,271 B2 * 10/2006 Hanzawa et al. ..... 439/159

FOREIGN PATENT DOCUMENTS

JP 2001-267013 9/2001
JP 2002-151205 5/2002
JP 2004-119148 4/2004
JP 2005-108569 4/2005

* cited by examiner

*Primary Examiner*—Neil Abrams
*Assistant Examiner*—Harshad C. Patel
(74) *Attorney, Agent, or Firm*—Frishauf, Holtz, Goodman & Chick, P.C.

(57) ABSTRACT

In a connector having a guiding member for guiding movement of a connection object in a fitting direction and a removing direction opposite to each other, a connection element is coupled to the guiding member to be connected to the connection object with movement of the connection object towards the fitting direction. The connection element is movable in a first range in the fitting and the removing directions. An ejecting mechanism is coupled to the guiding member to give the connection object a moving force towards the removing direction in response to the movement towards the fitting direction of the connection object connected to the connection element.

20 Claims, 15 Drawing Sheets

CONNECTOR WHICH CAN BE REDUCED IN OPERATING FORCE AND MINIATURIZED

This application claims priority to prior Japanese patent application JP 2005-254836, the disclosure of which is incorporated herein by reference.

BACKGROUND OF THE INVENTION

This invention relates to a connector having an ejecting mechanism for removing a connection object.

For example, Japanese Unexamined Patent Application Publication (JP-A) No. 2001-267013 discloses a push-push card connector comprising an insulator, a contact held by the insulator, an eject lever for removing a card, and a spring continuously urging the eject lever in a removing direction of the card. The insulator has a pair of frame portions for guiding the card. The eject lever is slidably mounted to one of the frame portions. The eject lever has a guided portion guided by the one frame portion and a card contacting portion to be pressed by an end of the card when the card is inserted and to press the end of the card when the card is removed.

Japanese Unexamined Patent Application Publication (JP-A) No. 2005-108569 discloses a card connector with a card lock mechanism. The card connector comprises a base member, a cover defining a receiving space between the base member and the cover to receive an IC card, the card lock mechanism for locking the IC card In the receiving space, and an ejecting mechanism for ejecting the IC card from the receiving space. The ejecting mechanism includes an ejecting member movable on the base member. The card lock mechanism has a locking member including an engaging part to be engaged with a recess of the IC card and a protrusion engaged with a long hole of the ejecting member. The ejecting mechanism further includes a heart cam and a cam lever disposed at a center area of the ejecting member to restrict or control the movement of the ejecting member, and two coil springs disposed on opposite sides of the ejecting member.

In the above-mentioned connectors, it is necessary to reserve or leave a clearance in order to avoid an interference with the insulator when the card slides. It is therefore difficult to miniaturize these connectors. Further, when the card is removed, a frictional force is produced due to a contacting force of the contact. Therefore, a spring load is increased and a large operating force is required. While the card is fitted to the connector, an operator may erroneously push the card although he does not intend to remove the card. In this event, electrical connection is undesiredly released. Further, when the card is removed, the card may jump out due to a surplus urging force of the spring.

SUMMARY OF THE INVENTION

It is therefore an object of this invention to provide a connector capable of being miniaturized and removing a connection object with a small operating force.

Other objects of the present invention will become clear as the description proceeds.

According to an aspect of the present invention, there is provided a connector comprising a guiding member for guiding movement of a connection object in a fitting direction and a removing direction opposite to each other, a connection element coupled to the guiding member to be connected to the connection object with movement of the connection object towards the fitting direction, and an ejecting mechanism coupled to the guiding member to give the connection object a moving force towards the removing direction in response to the movement towards the fitting direction of the connection object connected to the connection element, the connection element being movable in a first range in the fitting and the removing directions.

DESCRIPTION OF THE PREFERRED EMBODIMENTS

Figure 1:
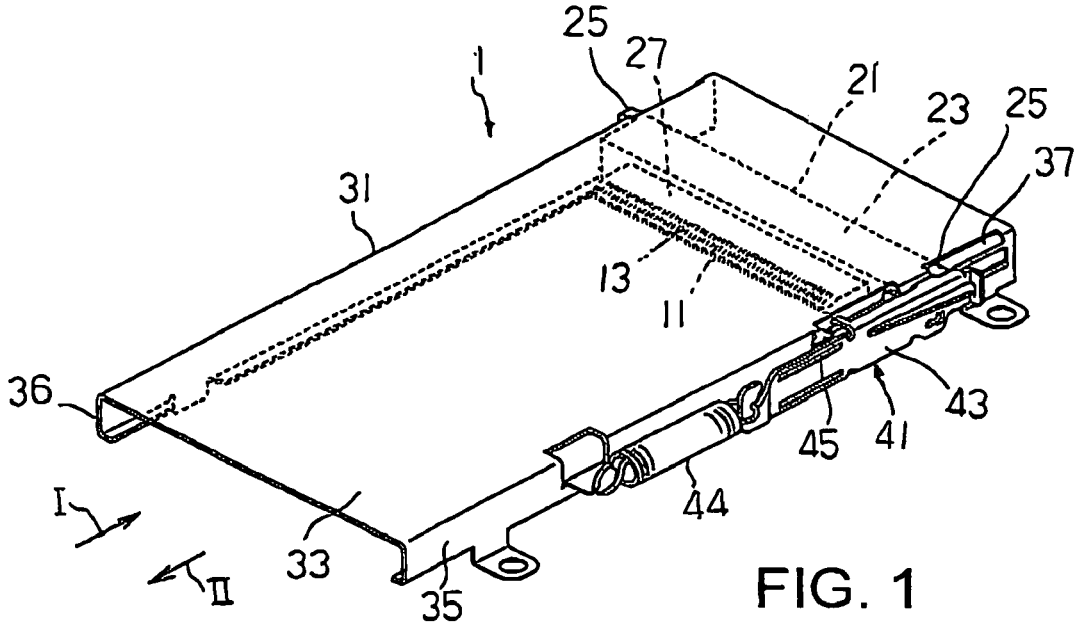
FIG. 1 is a perspective view of a connector according to a first embodiment of this invention.
Figure 2:
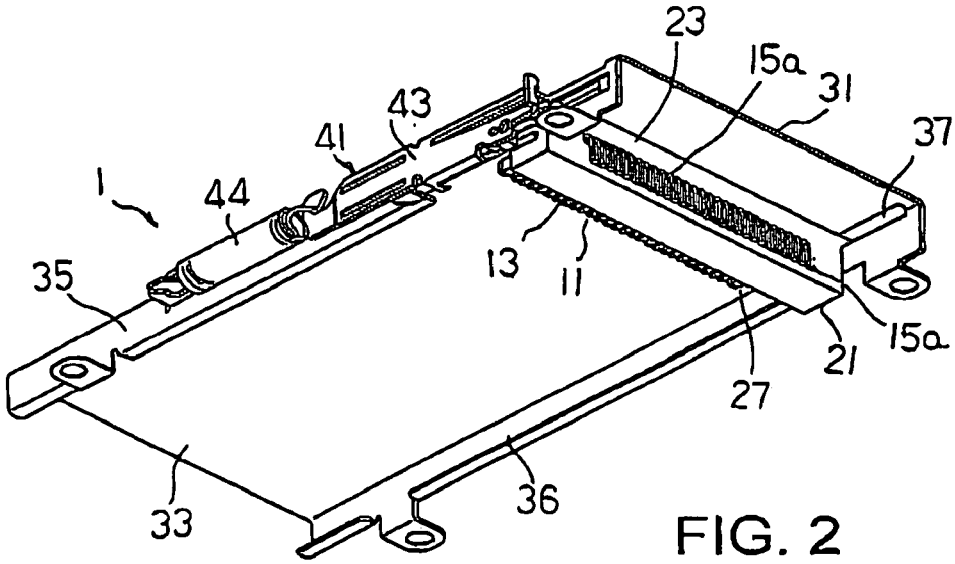
FIG. 2 is a bottom perspective view of the connector illustrated in FIG. 1.
Figure 3:
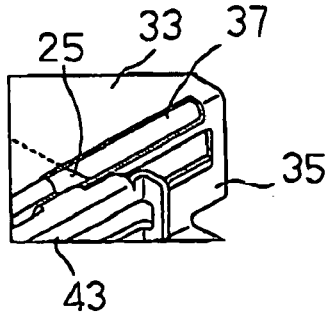
FIG. 3 is an enlarged perspective view of a part of the connector illustrated in FIG. 1.

Referring to FIGS. 1 to 3, description will be made of a connector according to a first embodiment of this invention.

The connector depicted at 1 in the figures comprises a plurality of conductive first contacts 11 to be connected to a connector object (not shown) such as a memory card, an insulating first base member 21 holding the first contacts 11, and a guiding member 31 for guiding insertion and removal of the connection object. A combination of the first contacts 11 and the first base member 21 will herein be called a connection element.

In the following description, the memory card as the connection object will simply be called a card. A direction in which the card is inserted into an insertion slot of the guiding member 31 to be connected to the first base member 21 will be called a fitting direction I. Another direction opposite to the fitting direction I will be called a removing direction 11.

Each of the first contacts 11 has a first contacting portion 13 to be connected to a card-side connector of the card, and a second contacting portion 15*a* to be connected to a board (not shown) to which the connector 1 is mounted.

The first base member 21 comprises a first base substrate 23, a pair of sliding portions 25 formed on opposite ends of the first base substrate 23 in a direction perpendicular to the fitting and the removing direction I and II, and a fitting portion 27 extending from the first base substrate 23 in the removing direction II.

The first base member 21 holds the first contacts 11 arranged in parallel and spaced from one another in a longitudinal direction of the first base member 21 which is perpendicular to the fitting direction I. In the fitting portion 27 of the first base member 21, the first contacting portions 13 of the first contacts 11 are located.

The guiding member 31 comprises a main plate portion 33 of a rectangular shape elongated in the fitting and the removing directions I and II, and a pair of guide frame portions 35 and 36 connected to opposite sides of the main plate portion 33 opposite to each other in the direction perpendicular to the fitting and the removing directions I and II, extending in parallel to each other, and faced to each other.

The first base member 21 is positioned on an Inner side of the guiding member 31 in the fitting direction I and between the guide frame portions 35 and 36. As shown in FIG. 3 also, the guiding member 31 is provided with a pair of sliding grooves 37 formed at connecting portions between the main plate portion 33 and the guide frame portions 35 and 36. Each of the sliding grooves 37 is formed on the inner side of the guiding member 31 in the fitting direction I as a long hole extending in the fitting and the removing directions I and II. The sliding portions 25 of the first base member 21 are engaged with the sliding grooves 37.

The sliding portions 25 of the first base member 21 are engaged with the sliding grooves 37 as mentioned above and, therefore, held by the guiding member 31 to be movable in the fitting and the removing directions I and II within a first range which is defined by the sliding grooves 37.

Further, on an outer side surface of the guide frame portion 35, an ejecting mechanism 41 is formed on the inner side of the guiding member 31 in the fitting direction I. The ejecting mechanism 41 is well known as a push-push ejecting mechanism which is disclosed in Japanese Unexamined Patent Application Publications (JP-A) Nos. 2005-108569, 2004-119148, 2002-151205, and 2001-267013.

Herein, the push-push ejecting mechanism will be described briefly. The ejecting mechanism 41 comprises a slider 43 slidably mounted to the guide frame portion 35, a coil spring 44 with its one end in the fitting direction I engaged with the guide frame portion 35, a heart cam 45 formed on the guide frame portion 35, and a cam follower (not shown) movable in a heart-shaped cam groove (not shown) formed in the heart cam 45. In order to connect the card to the contacts 11, the card is pressed in the fitting direction I to be connected to the contacts 11. When the card is removed, the card fitted to the connector 1 is pressed in the fitting direction I to become removable. The push-push ejecting mechanism will far later be described in detail.

Figure 4:
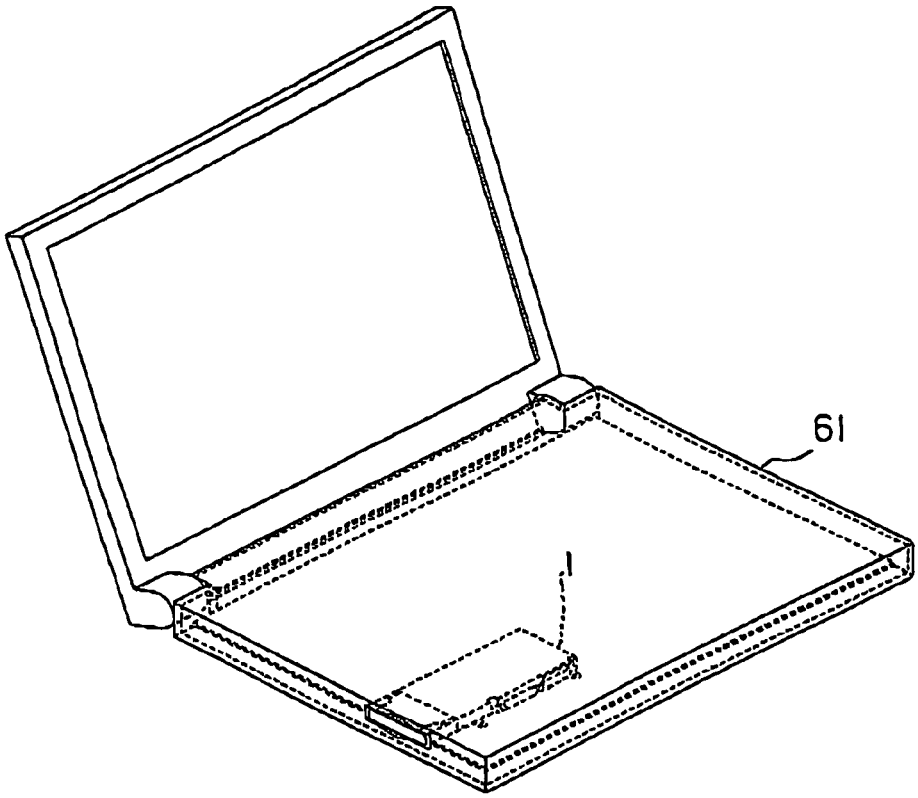
FIG. 4 is a perspective view of a notebook-type personal computer to which the connector illustrated in FIG. 1 is mounted.

FIG. 4 shows a state where the connector 1 is mounted to a notebook-type personal computer. In FIG. 4, the connector 1 is mounted to a housing 61 of the personal computer and operating keys and an operating portion on the housing 61 are omitted.

Figure 5:
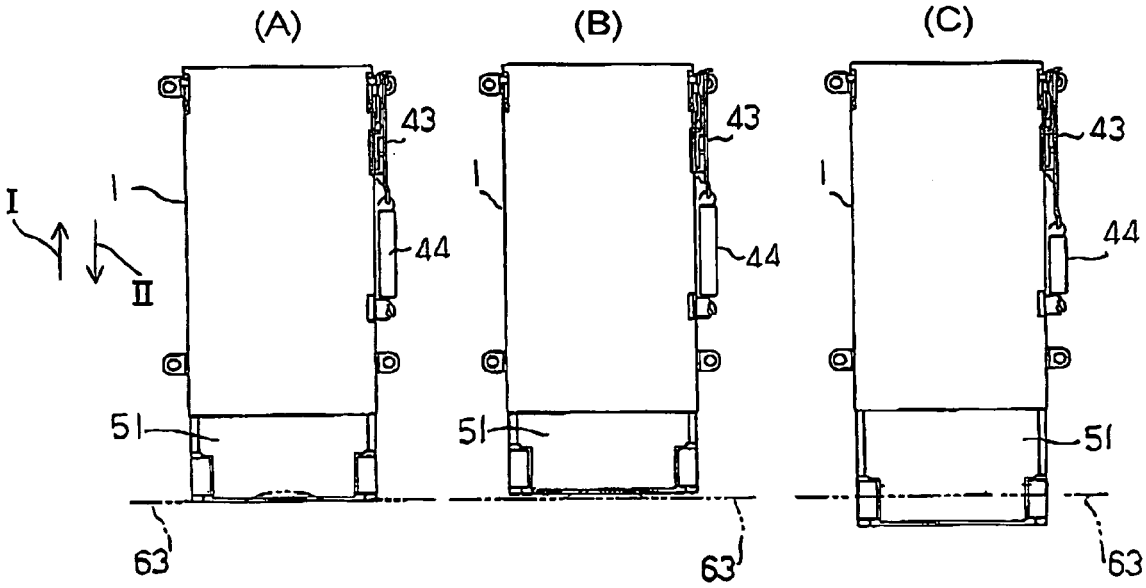
FIG. 5 is a view for describing a positional relationship between the connector Illustrated in FIGS. 1 and 2 and a card inserted into the connector, (A), (B), and (C) showing a fitted state, a pushed state, and a removed state, respectively.

FIG. 5 shows various positions of the card 51 inserted into the connector 1 Illustrated in FIG. 4. In FIG. 5, (A) shows a fitted state where the card 51 is fitted to the connector 1. (B) shows a pushed state where the card 51 is pushed into the connector 1. (C) shows a removed state where the card 51 is removed from the connector 1.

Generally, when the card 51 is at the fitted state as shown in (A), an end face of the card 51 in the removing direction II is flush with an outer contour 63 of the housing 61. When the card 51 is at the removed state as shown in (C), the card 51 protrudes outward from the outer contour 63 of the housing 61. Therefore, the card 51 can be held by fingers to be pulled out.

Figure 6:
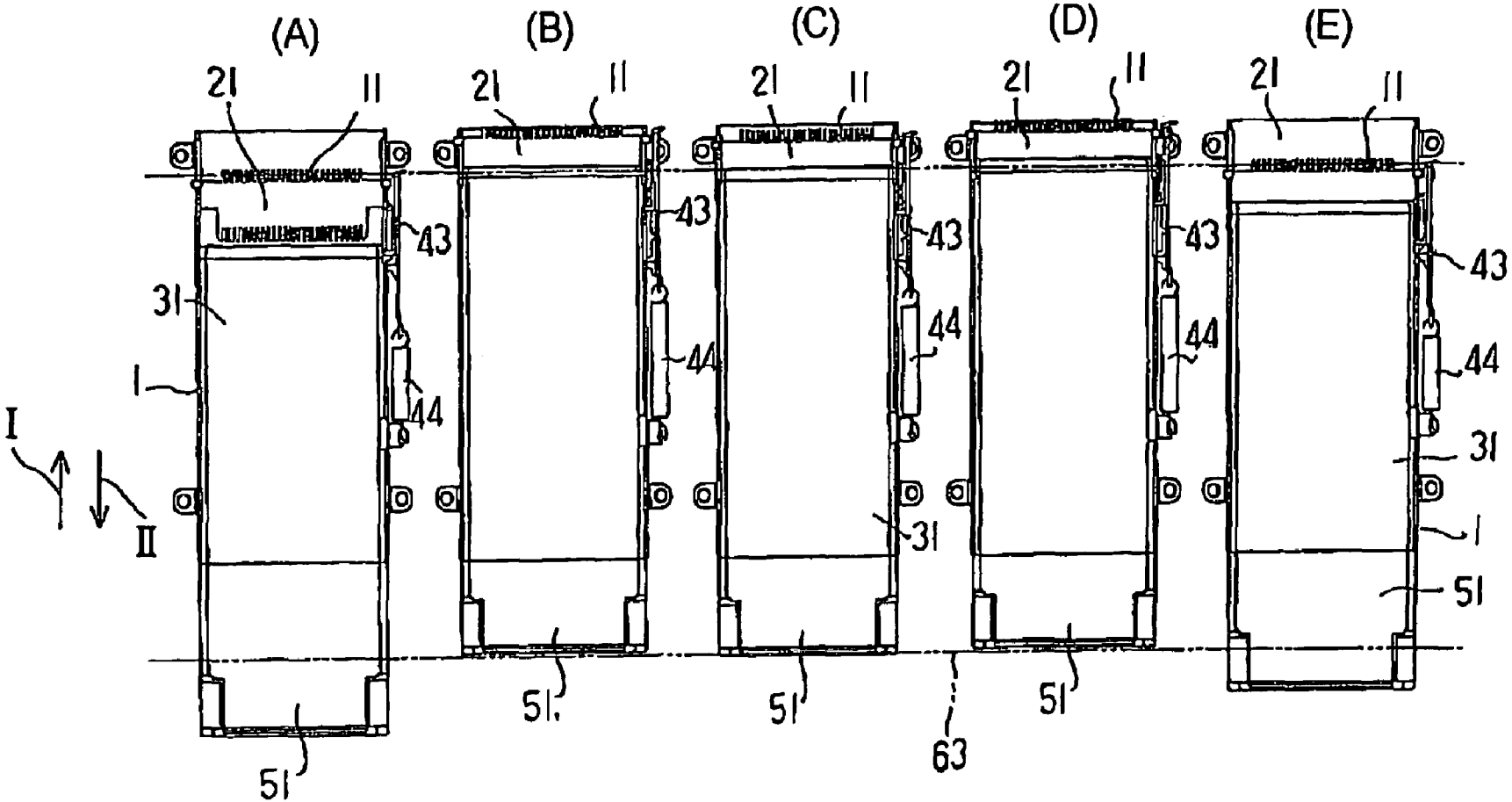
FIG. 6 is a view for describing a positional relationship between the card inserted into the connector illustrated in FIG. 5 and a base member, (A) showing a state where the card is inserted into the connector, (B), (C), (D), and (E) showing a primary-pushed state, the fitted state, a secondary-pushed state, and the removed state, respectively.

FIG. 6 shows a relationship between positions of the card 51 inserted into the connector 1 as illustrated in FIG. 5 and positions of the first base member 21. In FIG. 6, (A) shows an initial state where the card 51 is inserted into the connector 1. (B), (C), (D), and (E) show a primary-pushed state, a fitted state, a secondary-pushed state, and the removed state, respectively.

The first base member 21 is adapted to slide to the primary-pushed state shown in (B) or an inner position in the fitting direction I. The first base member 21 is adapted to slide to the removed state shown in (E) or a further forward position in the removing direction II.

In the initial state shown in (A), the card 51 is held by the fingers and inserted into the connector 1. The card 51 is pushed until the card 51 reaches a predetermined position after passing the fitted state shown in (C). Then, the card 51 is released from the fingers which have pushed the card 51. Consequently, under a load of the coil spring 44, the card 51 is returned to the fitted state shown in (C). Next, the card 51 is pushed to slide the card 51 to the predetermined position. Then, the card 51 is released from the fingers. Consequently, the card 51 moves beyond the fitted state shown in (C) until the card 51 reaches the removed state shown in (E). Finally, the card 51 is pulled out.

Between the primary-pushed state shown in (B) and the removed state shown in (E), the first base member 21 is kept electrically connected. Generally, the connector 1 is designed so that, when the card 51 is at the fitted state shown in (C), the end face of the card 51 in the removing direction II is flush with the outer contour 63 of the housing 61 shown in FIG. 4.

When the card 61 protrudes to the removed state shown in (E), the card 51 is easily held by the fingers and pulled out. The first base member 21 slides over a distance to the removed state shown in (E) but may slide beyond the removed state.

As will be understood from the foregoing description, the ejecting mechanism 41 includes a cam mechanism for restricting a behavior of the slider 43 within a second range in the fitting and the removing directions II. Herein, the first range is longer than the second range in the removing direction II.

With the above-mentioned connector, the connection object and the connection element are integrally moved when the connection object is inserted and removed. Therefore, it is possible to miniaturize the connector. In addition, unnecessary friction is not produced between the connection object and the contacts. Therefore, the coil spring 44 can be designed to exert a small force and the connector can be operated with a small operating force.

When the connection object is in a fitted state, the connection object may erroneously be pushed although an operator does not intend to remove the connection object. Even in this event, electrical connection between the connection object and the contacts is not released. Therefore, use is continuously be made by pushing the connection object again.

Further, when the connection object is at the removed state, connection between the connection object and the base member is not released. Therefore, the connection object is prevented from jumping out due to a surplus urging force of the coil spring 44.

Figure 7:
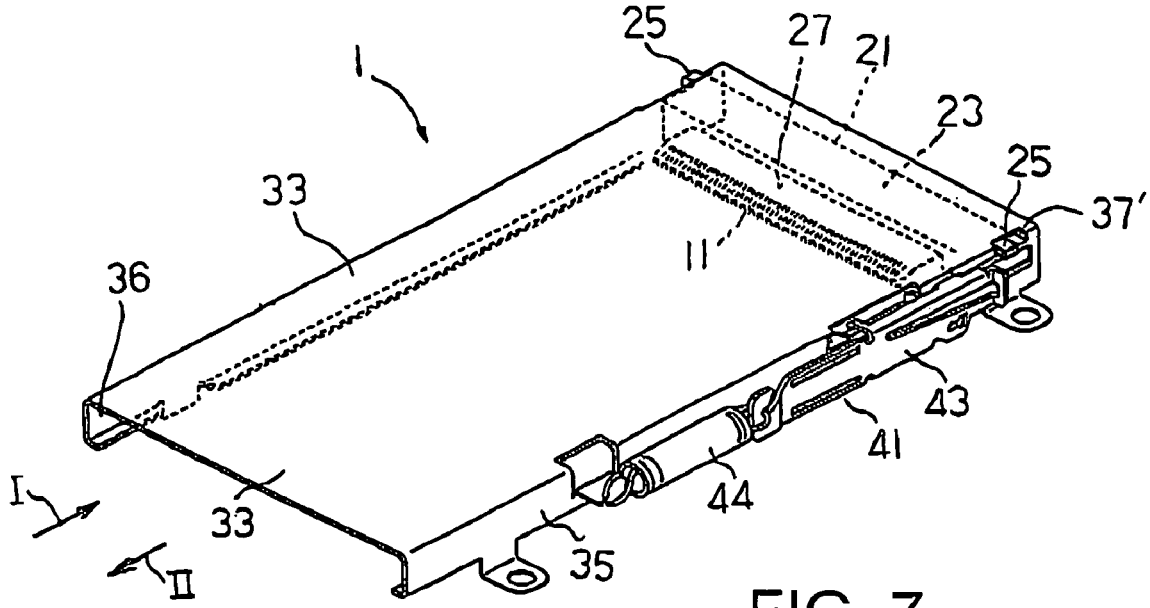
FIG. 7 is a perspective view of a connector according to a second embodiment of this invention.
Figure 8:
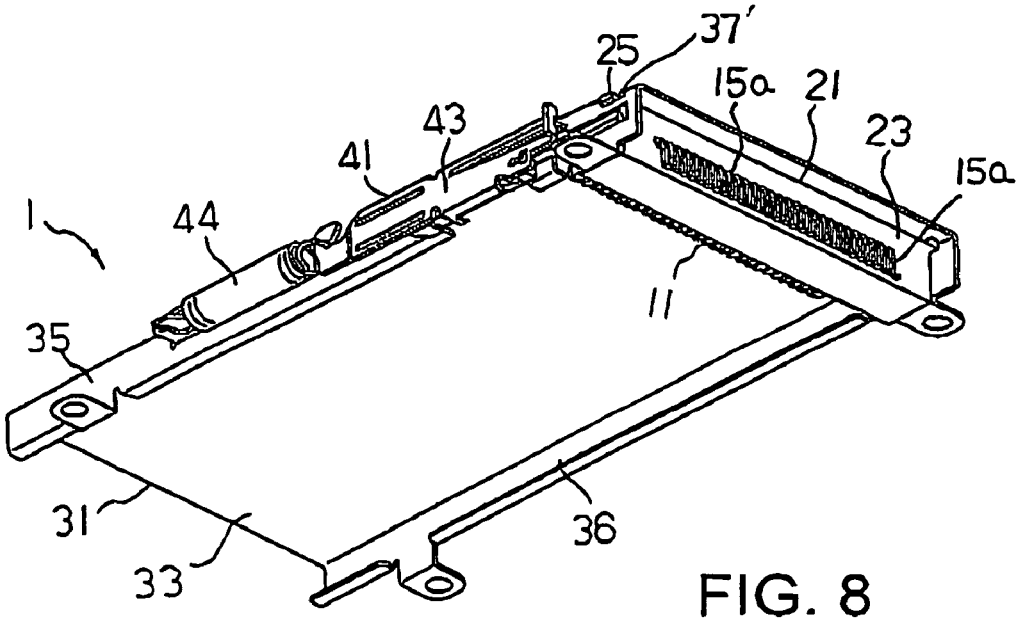
FIG. 8 is a bottom perspective view of the connector illustrated in FIG. 7.
Figure 9:
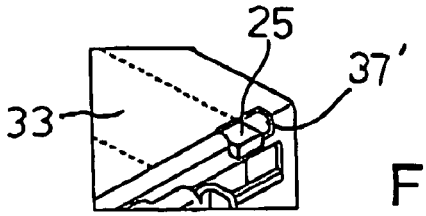
FIG. 9 is an enlarged perspective view of a part of the connector illustrated in FIG. 7.

Referring to FIGS. 7 to 9, description will be made of a connector according to a second embodiment of this invention. Similar parts are designated by like reference numerals and description thereof will be omitted. Herein, a combination of the first contacts 11 and the first base member 21 will also be called the connection element.

The first base member 21 is located between the guide frame portions 35 and 36 on the inner side of the guiding member 31 in the fitting direction I. As shown in FIG. 9 also, the guiding member 31 is provided with a pair of sliding grooves 37' formed at the connecting portions between the main plate portion 33 and the guide frame portions 35 and 36.

Each of the sliding grooves 37' is formed on the inner side of the guiding member 31 in the fitting direction I as a long hole extending in the fitting and the removing directions I and II. The sliding portions 25 of the first base member 21 are engaged with the sliding grooves 37'.

Thus, the sliding portions 25 of the first base member 21 are engaged with the sliding grooves 37' and, therefore, held by the guiding member 31 to be movable within the first range in the fitting and the removing directions I and II.

Figure 10:
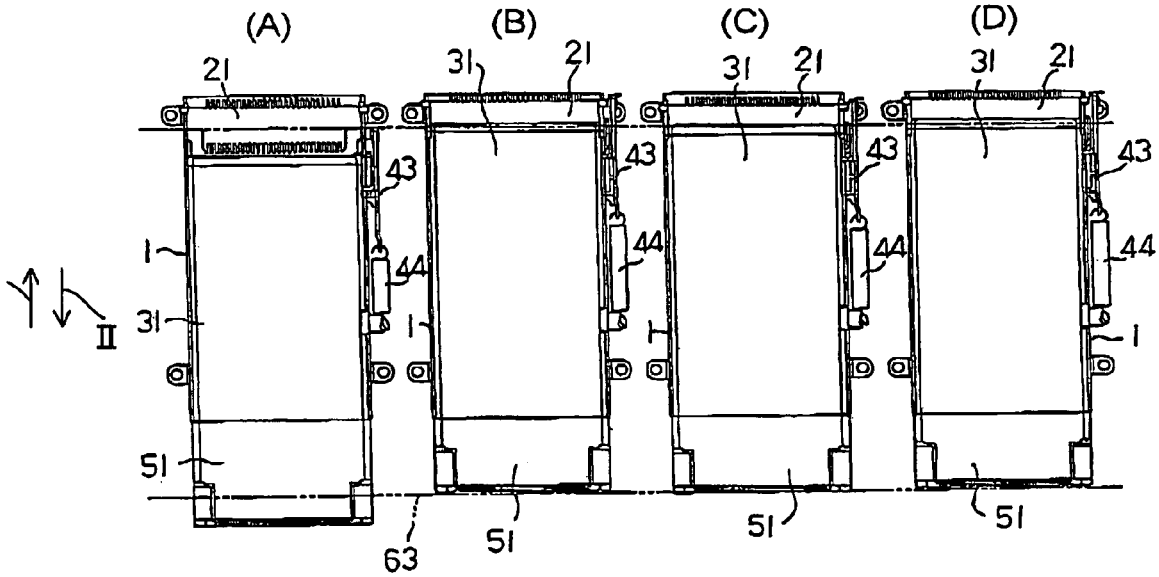
FIG. 10 is a view for describing a positional relationship between a card inserted into the connector illustrated in FIG. 7 and a base member, (A) showing an initial state where the card is inserted into the connector, (B), (C), and (D) showing a primary-pushed state, a fitted state, and a secondary-pushed state, respectively.

FIG. 10 shows a relationship between positions of the card 51 inserted into the connector 1 shown in FIGS. 7 to 9 and positions of the first base member 21. In FIG. 10, (A) shows a removed state where the card 51 is removed from the connector 1. (B), (C), and (D) show a primary-pushed state, a fitted state, and a secondary-pushed state, respectively.

The first base member 21 is adapted to slide to the pushed state shown in (B) or an inner position in the fitting direction I. The first base member 21 is adapted to slide to the fitted state shown in (C) or a further forward position in the removing direction II. The first base member 21 stops at a position inner than the removed state shown in (A).

At the removed state shown in (A), the card 51 is held by the fingers and inserted into the connector 1. The card 51 is pushed until the card 51 reaches a predetermined position after passing the fitted state shown in (C). Then, the card 51 is released from the fingers which have pushed the card 51. Consequently, under the load of the coil spring 44, the card 51 is returned to the fitted state shown in (C). Next, the card 51 is pushed to slide the card 51 to the predetermined position. Then, the card is released from the fingers. Consequently, the card 51 moves beyond the fitted state shown in (C) to be removed.

The first base member 21 slides from the primary-pushed state of (B) to the fitted state shown in (C). As a consequence, the first base member 21 and the card 51 are disconnected. At the removed state shown in (A), the first contacts 11 are disconnected so that the card 51 can be taken out without friction.

Generally, the connector 1 is designed so that, when the card 51 is at the fitted state shown in (C), the end face of the card 51 in the removing direction II is flush with the outer contour 63 of the housing 61 shown in FIG. 6.

When the card 51 protrudes to the removed state shown in (A), the card 51 is easily held by the fingers and pulled out. The first base member 21 slides over a distance to the fitted state shown in (C) but may slide beyond the fitted state up to the removed state.

As will be understood from the foregoing description, the ejecting mechanism 41 includes the cam mechanism for restricting the behavior of the slider 43 within the second range in the fitting and the removing directions II. Herein, the second range is longer than the first range in the removing direction II.

Figure 11:
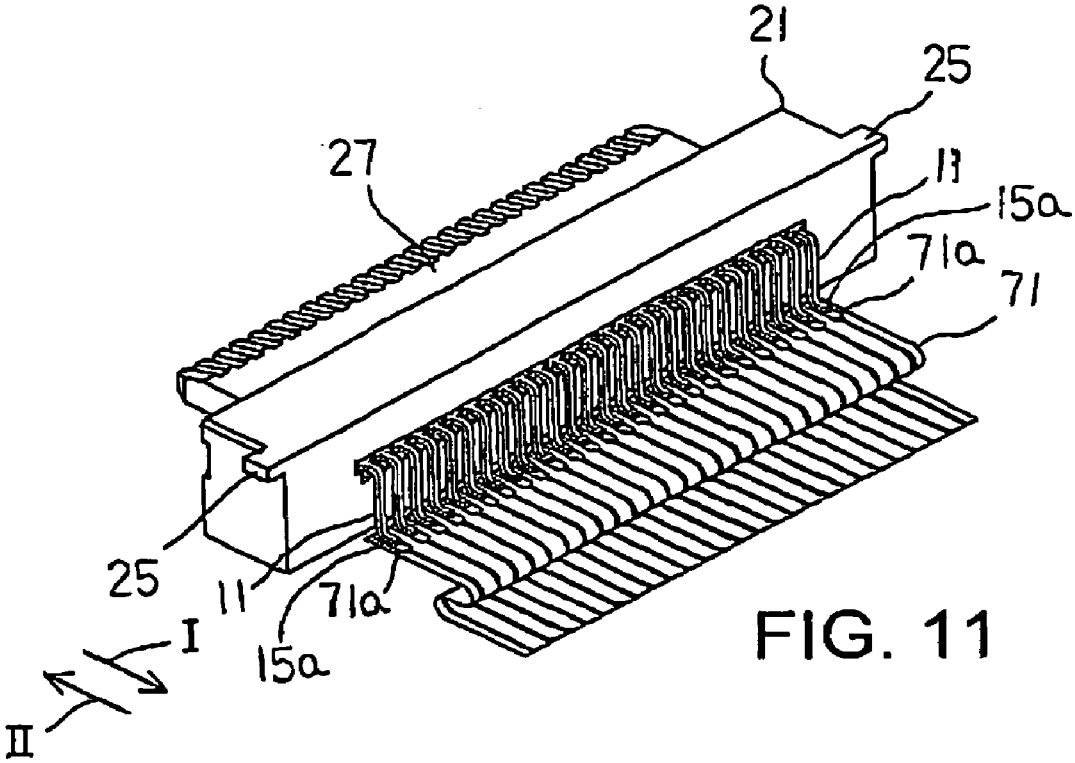
FIG. 11 is an enlarged perspective view of a characteristic part of an example when the connector is connected to a flexible member.

FIG. 11 shows an example where the first base member 21 of the connector 1 is connected to a flexible member 71.

In FIG. 11, the second contacting portions 15*a* of the first contacts 11 held by the first base member 21 are connected to conductive portions 71*a* of the flexible member 71 such as a FPC (flexible printed circuit) and a FFC (flexible flat cable). In this case, the flexible member 71 is variously deformed following the movement of the first base member 21 in the fitting and the removing directions I and II.

Figure 12:
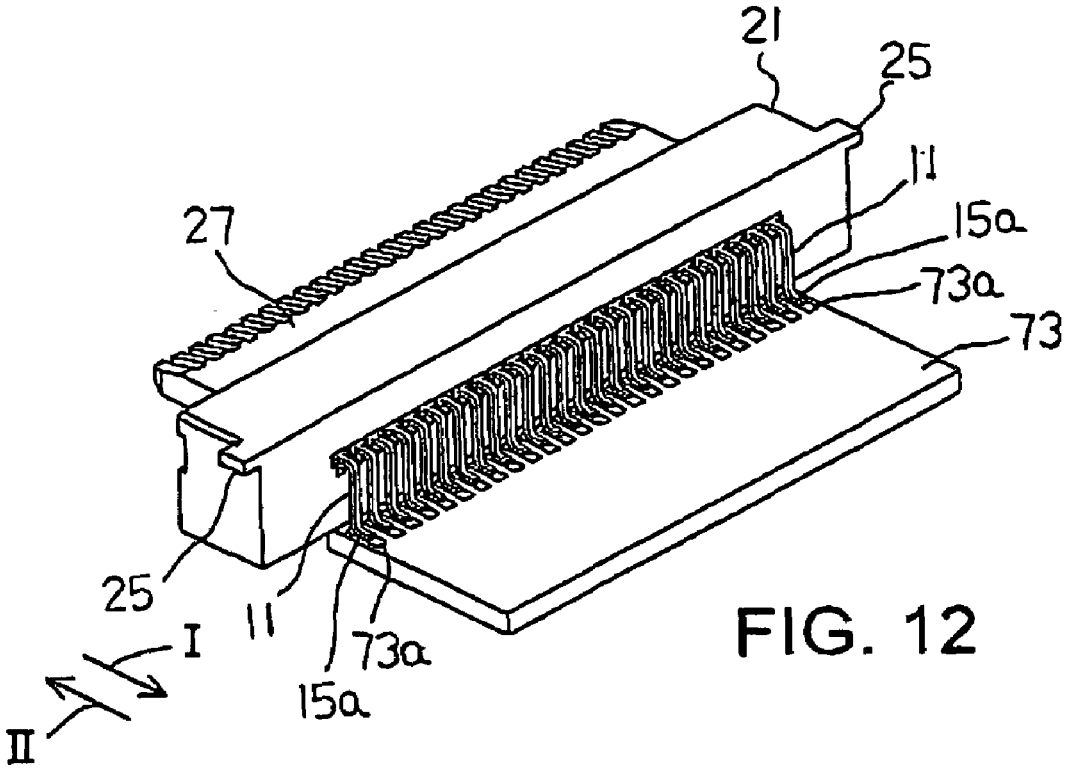
FIG. 12 is an enlarged perspective view of a characteristic part of an example when the connector is connected to a rigid member.

FIG. 12 shows an example where the first base member 21 of the connector 1 is connected to a board 73 as a rigid member.

In FIG. 12, the second contacting portions 15*a* of the first contacts 11 held by the first base member 21 are fixed and connected to conductive portions 73*a* of the board 73 such as a printed wiring board. In this case, the board 73 slides in the fitting and the removing directions I and II integrally with the first base member 21.

Figure 13:
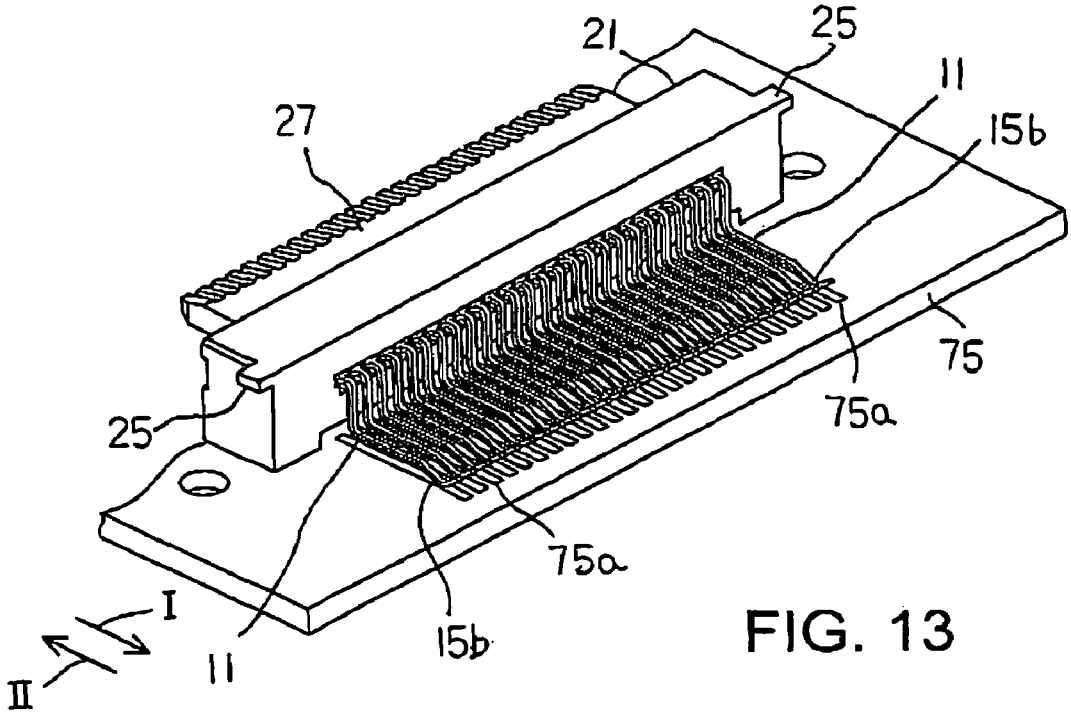
FIG. 13 is an enlarged perspective view of a characteristic part of an example when the connector is connected to a board.

FIG. 13 shows an example where the first base member 21 of the connector 1 is connected to a board 75.

In FIG. 13, second contacting portions 15*b* of the first contacts 11 are slidably contacted with conductive portions (conductive pads) 75*a* formed on the board 75 fixed to an apparatus to which the connector 1 is mounted. In this case, following the movement of the first base member 21 in the fitting and the removing directions I and II, the second contacting portions 15*b* slides on the conductive portions 75*a* of the board 75.

Figure 14:
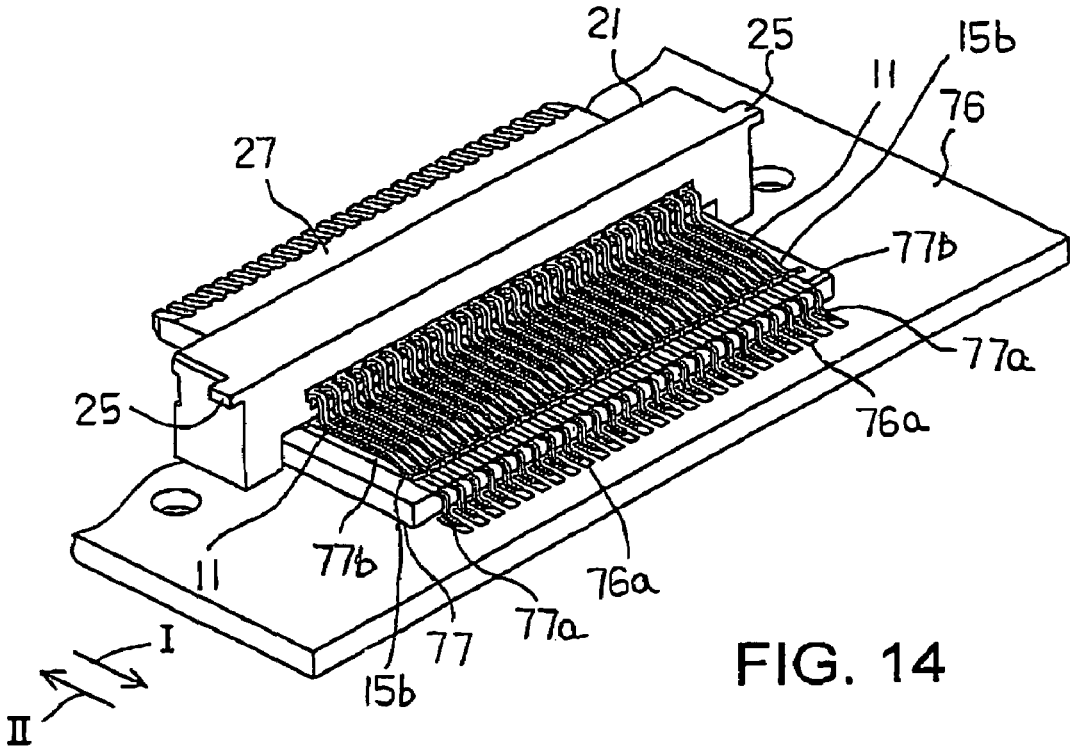
FIG. 14 is an enlarged perspective view of a characteristic part of another example when the connector is connected to a board.

FIG. 14 shows an example where the first base member 21 of the connector 1 is connected to a board 76.

In FIG. 14, a second base member 77 is coupled with the first base member 21. The second base member 77 holds a plurality of second contacts 77*a* and is fixedly mounted to the board 76 fixed to the apparatus. The second base member 77 has a plurality of conductive portions 77*b*. Each of the second contacts 77*a* has a first connecting portion 77*a* connected to each corresponding one of a plurality of conductive portions 76*a* of the board 76 and a second connecting portion (conductive pad) 77*b* slidably contacted with each corresponding one of the second contacting portions 15*b* of the first contacts 11. In this case, following the movement of the second base member 21 in the fitting and the removing directions I and II, the second contacting portions 15*b* of the first contacts 11 slide on the conductive portions 77*b* of the second base member 77.

Figure 15:
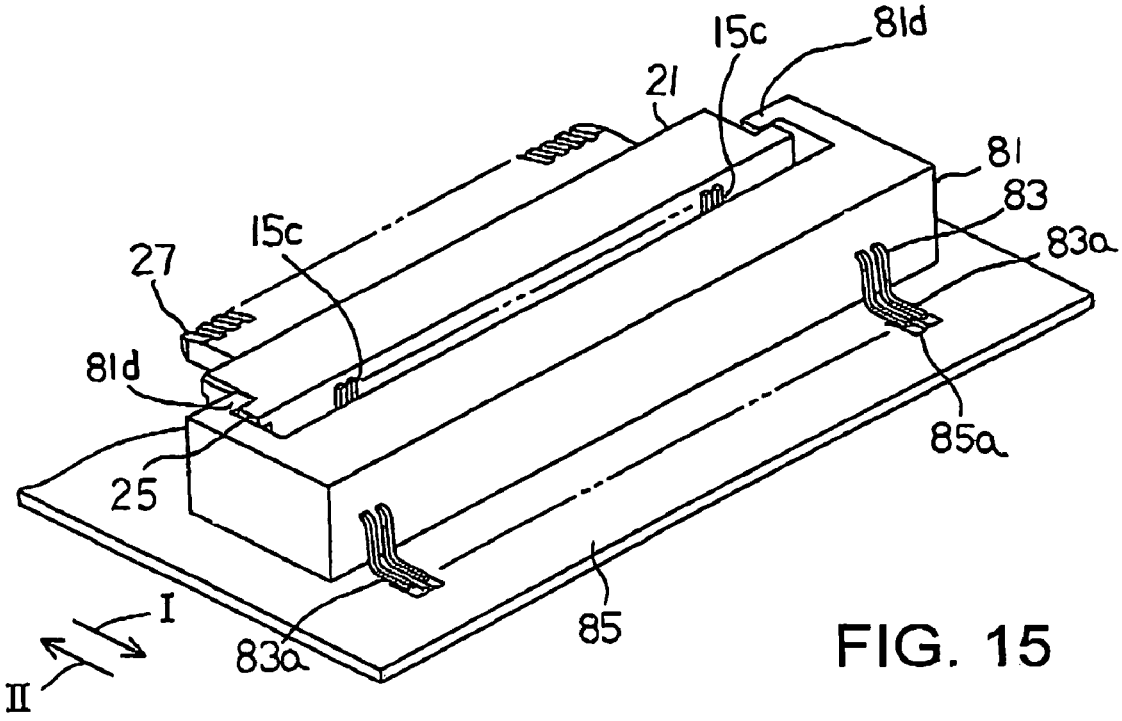
FIG. 15 is an enlarged perspective view of a characteristic part of still another example when the connector is connected to a board.
Figure 16:
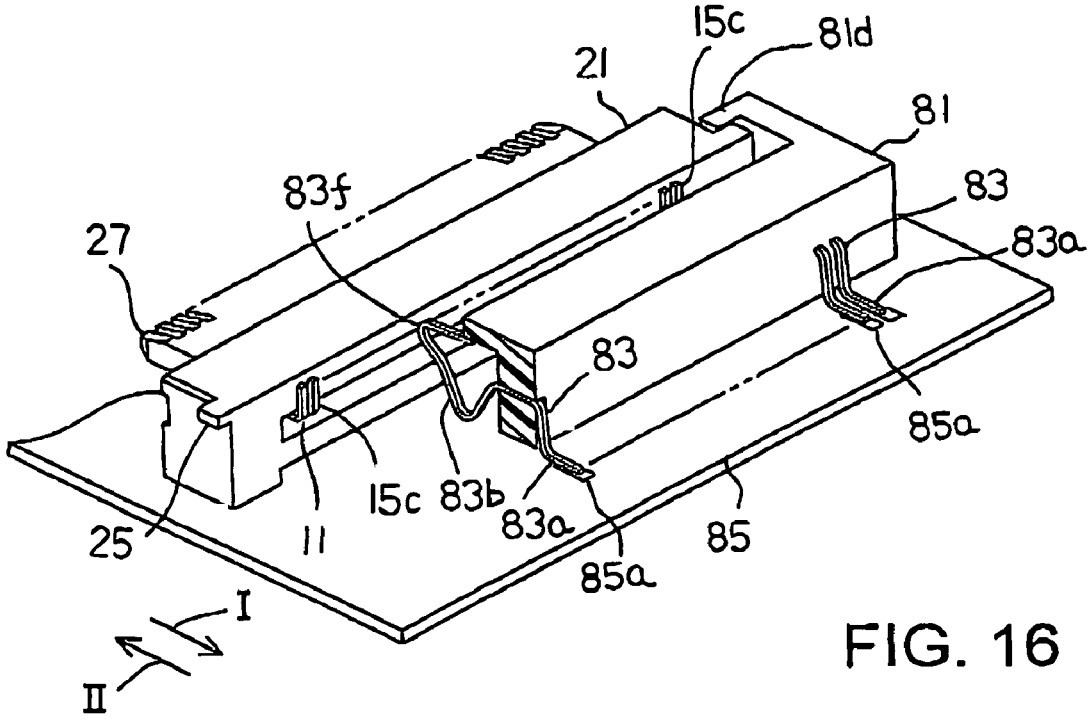
FIG. 16 is a perspective view of the example illustrated in FIG. 15, partially in section.

FIGS. 15 and 16 show still another example where the connector I is connected to a board 85.

In FIGS. 15 and 16, the board 85 fixed to the apparatus is provided with a plurality of conductive portions (conductive pads) 85*a*. On the board 85, the first base member 21 and a second base member 81 coupled with the first base member 21 are mounted. The first base member 21 holds the conductive first contacts 11 to be connected to the card 51.

The second base member 81 holds a plurality of second contacts 83. Each of the first contacts 11 has a first contacting portion (not shown) to be connected to the card 51 and a second contacting portion 15*c* to be connected to each corresponding one of the second contacts 83. Each of the second contacts 83 has a first connecting portion 83*a* connected to each corresponding one of the conductive portions 85*a* of the board 85 and a second connecting portion 83*b* to be connected to each corresponding one of the second contacting portion 15*c* of the first contacts 11.

The second base member 81 is provided with a pair of guide frame portions 81*d* formed on longitudinal opposite ends and engaged with the sliding portions 25 of the first base member 21 so that the first base member 21 is movable in the fitting and the removing directions I and II. The first base member 21 is movably held by the second base member 81 within a first range in the fitting and the removing directions I and II.

The second connecting portion 83*b* of the second contact 83 is formed into a cantilevered spring. The second connecting portion 83*b* has an end portion bent into a generally U shape. An outer surface of the end portion serves as a contact point portion 83*f*. The contact point portion 83*f* is contacted with the second contacting portion 15*c* of the first contact 11 elastically in the fitting and the removing directions I and II.

Thus, the second connecting portion 83*b* of the second contact 83 is formed as a spring contact point. Alternatively, the second contacting portion 15*c* of the first contact 11 may be formed as a spring contact point. In either case, by an action of the spring contact point, the first base member 21 is rendered slidable in the fitting and the removing directions I and II with respect to the second base portion 81.

Figure 17:
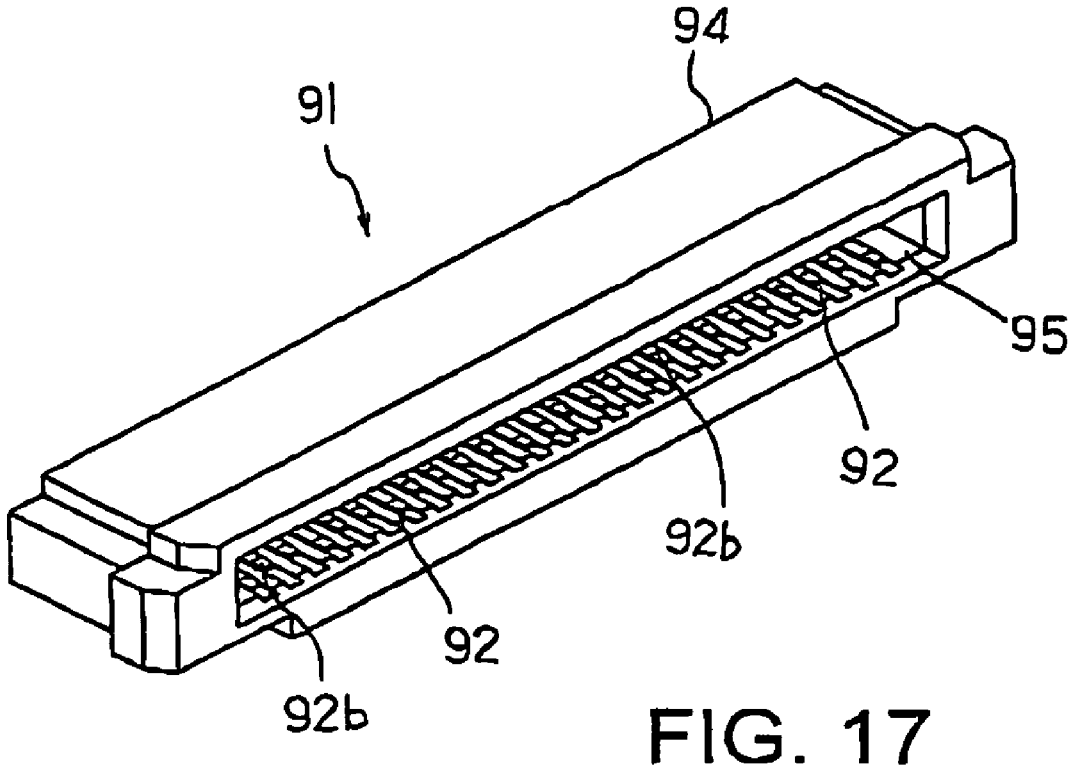
FIG. 17 is a perspective view of a mating connector (card-side connector) equipped in the card as a connection object.
Figure 18:
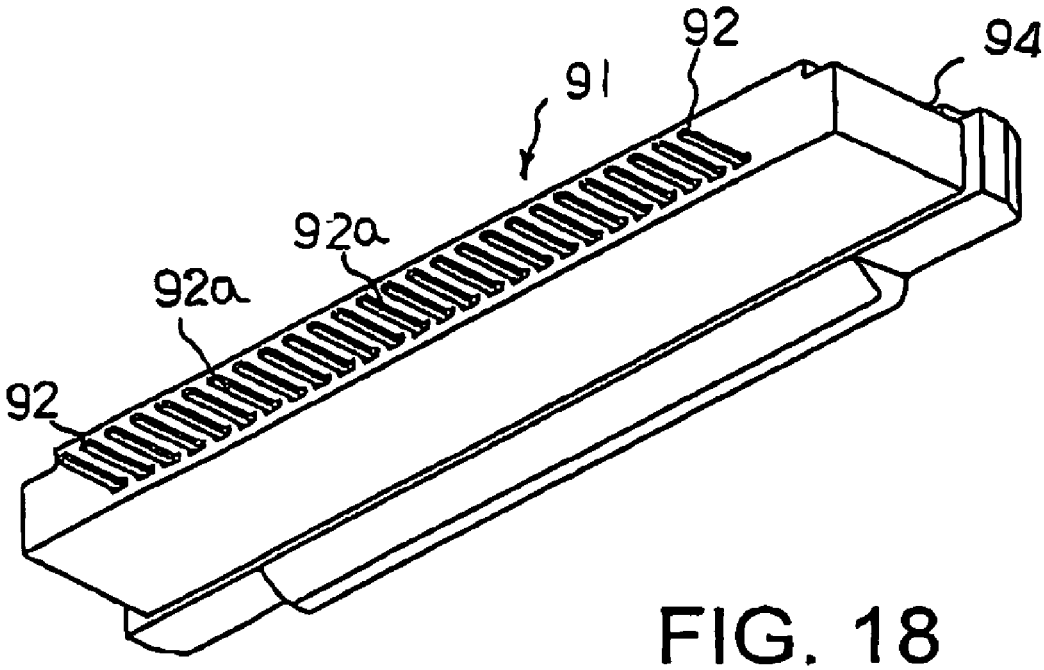
FIG. 18 is a perspective view of the mating connector illustrated in FIG. 17 as seen in a different direction.

FIGS. 17 and 18 shows a mating connector (card-side connector) 91 equipped in the card 51 as a connection object.

In FIGS. 17 and 18, the card-side connector 91 has a plurality of mating contacts 92 and a mating base member 94 holding the mating contacts 92. Each of the mating contacts 92 has a mating first contacting portion 92*a* to be connected to the first contacting portion 13 of each corresponding one of the first contacts 11 and a mating second contacting portion 92*b* to be connected to a circuit of the card 51. The mating base member 94 is provided with a mating fitting portion 95 for receiving the fitting portion 27 of the first base member 21 to be fitted thereto. In the mating fitting portion 95, the mating second contacting portions 92*b* are located.

Figure 19:
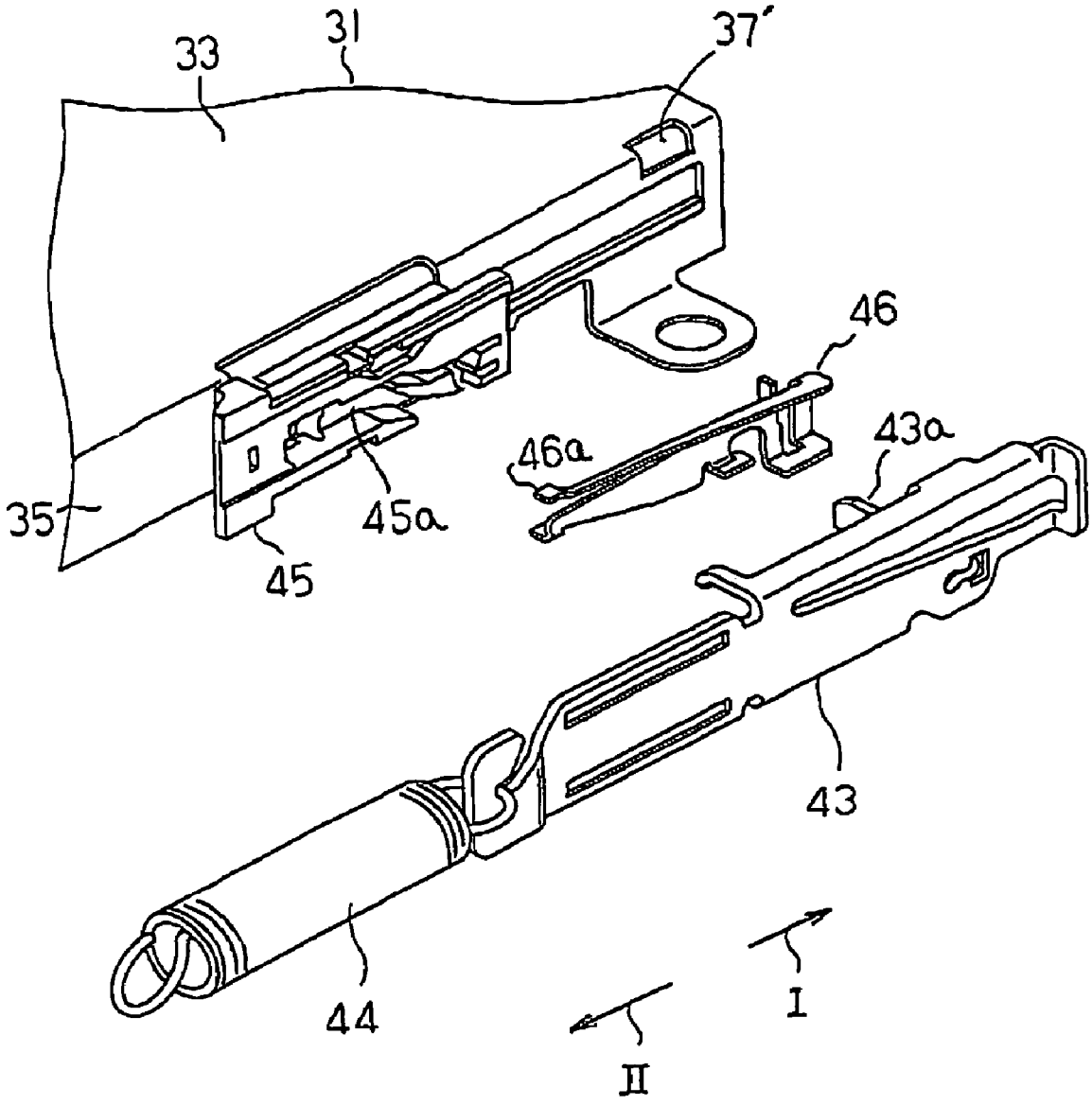
FIG. 19 is an exploded perspective view of a push-push ejecting mechanism contained In each of the connectors according to the first and the second embodiments.

FIG. 19 shows a push-push ejecting mechanism contained in each of the above-mentioned connectors.

The push-push ejecting mechanism 41 comprises the slider 43 slidably mounted to the guide frame portion 35, the coil spring 44 connected to the slider 43, the heart cam 45 formed on the guide frame portion 35, and the cam follower 46 engaged with the cam groove 45*a* in the heart cam 45.

The slider 43 is connected to the other end of the coil spring 44 having the one end engaged with the guide frame portion 35. Following the movement of the slider 43, the cam follower 46 moves under the restriction by the cam groove 45*a* of the heart cam 45. The cam follower 46 is provided with a guide pin 46*a* movable along the cam groove 45*a*. In order to allow the movement of the guide pin 46*a*, the cam follower 46 is adapted to rotate over a predetermined angle.

At an initial position where a part of the card 51 is inserted into the connector 1, the guide pin 46*a* of the cam follower 46 is positioned at a starting point of the cam groove 45*a* of the heart cam 45. Next, when the card 51 is pushed in the fitting direction I, a forward end of the card 51 is brought into contact with a card contacting portion 43*a* of the slider 43. Thereafter, the card 51 and the slider 43 integrally slide in the fitting direction I against the coil spring 44. As a consequence, the guide pin 46*a* is positioned at a guiding portion of the cam groove 45*a* of the heart cam 45, which is inclined with respect to a sliding direction of the slider 43.

Subsequently, after the card 51 is pushed to a maximum stroke, the pushing operation is stopped. Then, the card 51 and the slider 43 are slightly returned by a restoring force of the coil spring 44. The guide pin 46*a* stops at a stopping point of the cam groove 45*a* of the heart cam 45. Thus, a fitting operation of the card 51 is completed.

Again, the card 51 is pushed to the maximum stroke and thereafter the pushing operation is stopped. Then, the guide pin 46*a* escapes from the stopping point of the cam groove 45*a* of the heart cam 45, passes through a guiding portion parallel to the sliding direction of the slider 43, and reaches an end point, i.e., the starting point. The card 51 and the slider 43 are returned by the restoring force of the coil spring 44. Thus, a removing operation of the card 51 is completed.

Figure 20:
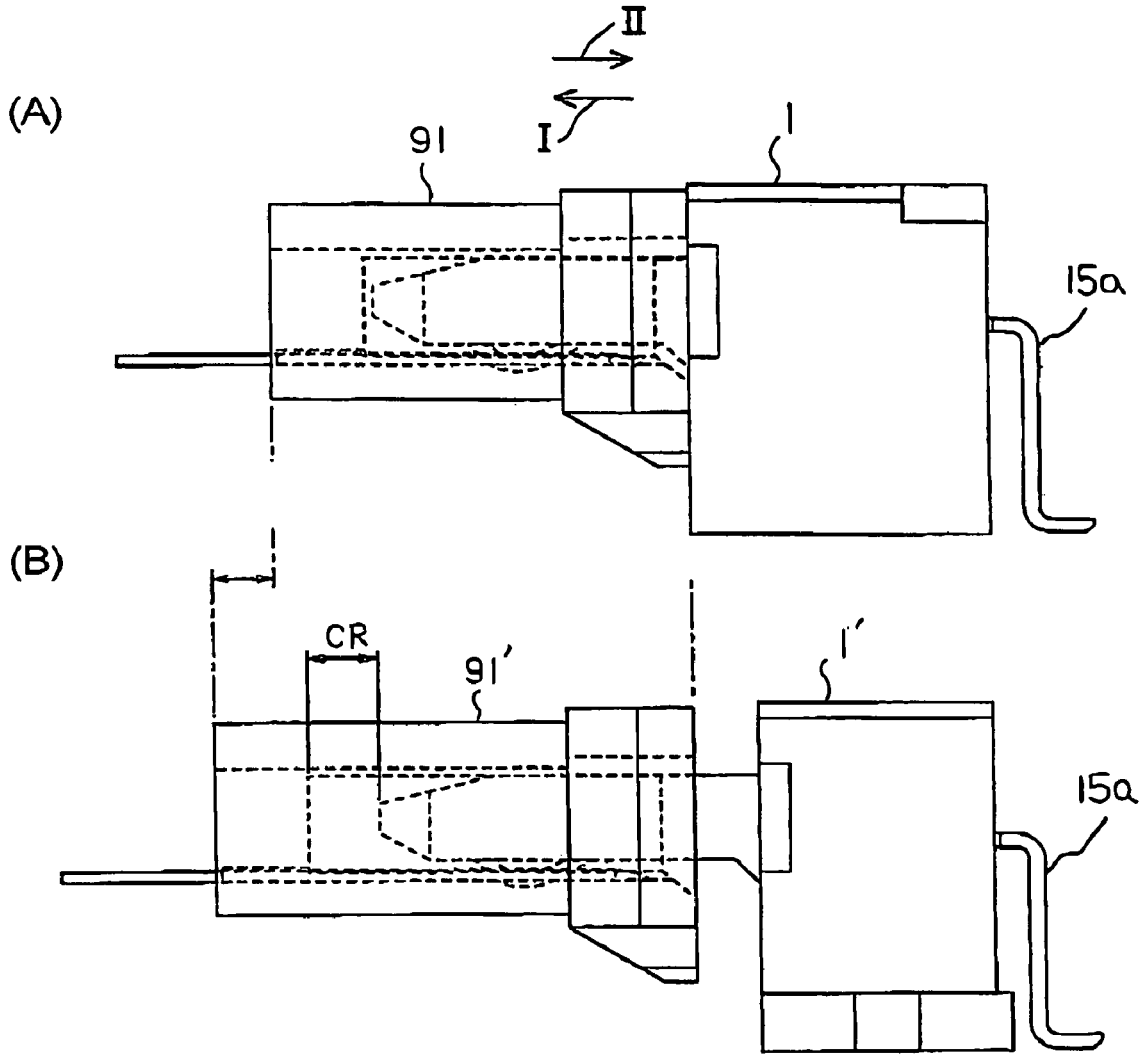
FIG. 20 is a side view for comparing a connector (A) according to this invention and an existing connector (B)

Referring to FIG. 20, comparison will be made between the connector (A) according to this invention and an existing connector (B).

As shown in (A) of FIG. 20, the first base member 21 and the card-side connector 91 shown in FIGS. 17 and 18 slide together. Therefore, a clearance CR in the fitting and the removing directions I and II, which is required in the existing connector 1' in (B), is unnecessary.

Because the clearance CR is unnecessary, the card-side connector 91 illustrated in FIGS. 17 and 18 can be miniaturized and a dead space inside the card 51 is reduced.

On the other hand, in the existing connector 1', the clearance CR corresponding to a sliding distance from the fitted state to the pushed state is required. Therefore, a card-side connector 91' is increased in size.

With the above-mentioned connector, the connection object and the connection element integrally move when the connection object is inserted and removed. Therefore, the connector can be miniaturized and unnecessary friction is not produced between the connection object and the contacts. Therefore, the coil spring 44 can be designed to exert a small force and the connector can be operated with a small operating force.

Referring to FIGS. 21 to 25, description will be made of a connector according to a third embodiment of this invention.

In FIGS. 21 to 25, the connector 101 comprises a plurality of conductive first contacts 111 to be connected to a card 151, a first base member 121 holding the first contacts 111, a guiding member 131 for guiding insertion of the card 151, an ejecting mechanism 141, and a FPC 171 connected to the first contacts 111. Each of the first contacts 111 has a first contacting portion 113, and a second contacting portion 151 connected to a FPC connector equipped in the FPC 171. Herein, a combination of the first contacts 111 and the first base member 121 will be called a connection element.

The ejecting mechanism 141 is operated in the following manner. By pressing the card 151 in the fitting direction I, the card 151 is connected. By pressing the card 151 in a fitted state is pressed in the fitting direction I, the card 151 is rendered removable.

The first base member 121 comprises a base substrate 123, a pair of sliding portions 125 and 126 formed at opposite ends of the base substrate 123 in the direction perpendicular to the fitting and the removing directions I and II, and a fitting portion 127 extending in the removing direction II. The first base member 121 holds the first contacts 111 arranged in parallel and spaced from one another in a longitudinal direction of the first base member 121 which is perpendicular to the fitting direction I. In the fitting portion 127 of the first base member 121, the first contacting portions 113 of the first contacts 111 are located.

The guiding member 131 comprises a main plate portion 133 of a rectangular shape, and a pair of guide frame portions 135 and 136 connected to opposite sides of the main plate portion 133 opposite to each other in the direction perpendicular to the fitting and the removing directions I and II, extending in parallel to each other, and faced to each other.

The first base member 121 is positioned on an inner side of the guiding member 131 in the fitting direction I and between the guide frame portions 135 and 136. The guiding member 131 is provided with a pair of sliding holes 135*b* and 136*b* formed in the guide frame portions 135*a* and 136*b* extending in the fitting direction I, respectively. Each of the sliding holes 135*b* and 136*b* is formed on the inner side of the guiding member 131 in the fitting direction I as a long hole extending in the fitting and the removing directions I and II. The sliding portions 125 and 126 of the base member 121 are engaged with the sliding holes 135*b* and 136*b* in one-to-one correspondence.

The sliding portions 125 and 126 of the first base member 121 are engaged with the sliding holes 135*b* and 136*b* as mentioned above and, therefore, held by the guiding member 131 to be movable within a first range in the fitting and the removing directions I and II.

The ejecting mechanism 141 comprises a cam member 145 elongated in the direction perpendicular to the fitting and the removing directions I and II, and two coil springs 147. The cam member 145 is provided with a cam protrusion (heart cam) 146 formed at its center. The main plate portion 133 is provided with an engaging part 133*a* formed by cutting and bending the main plate portion 133. The engaging part 133*a* is located at the center of the main plate portion 133 in the direction perpendicular to the fitting and the removing direction II and at a position towards the fitting direction I. The engaging part 133*a* corresponds to the guide pin 46*a* of the cam follower 46 in FIG. 19.

Each of the coil springs 147 has one end engaged with each of engaging parts 133*b* formed by cutting and bending the main plate portion 133 at positions towards the removing direction II. The coil springs 147 has the other ends engaged with longitudinal opposite ends of the cam member 145, respectively.

Figure 26:
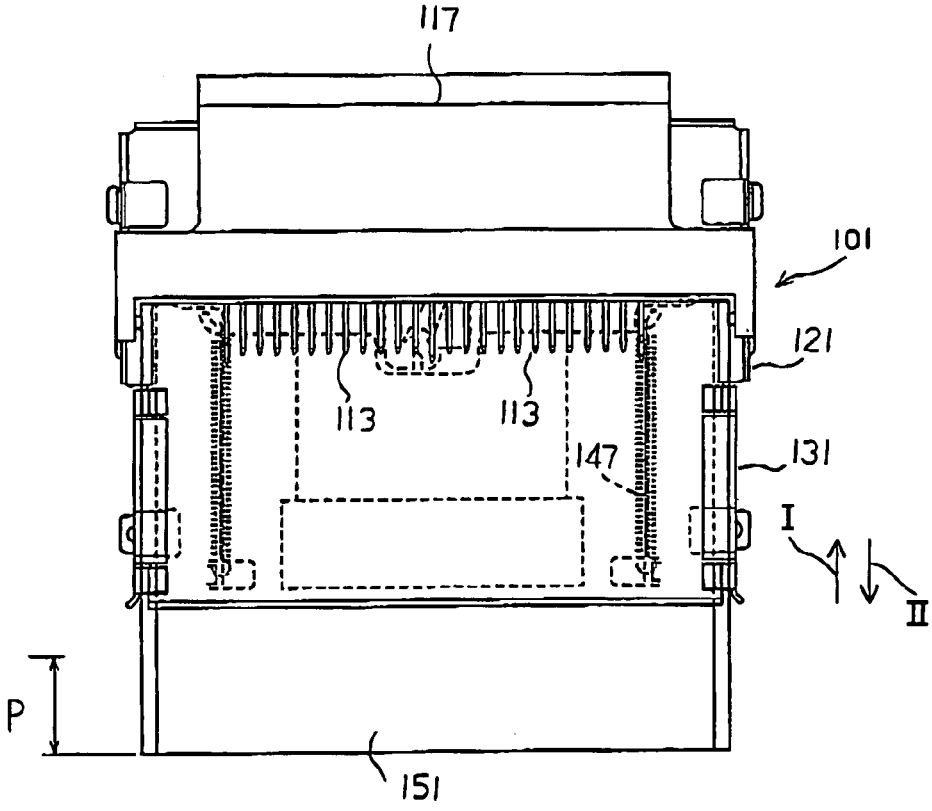
FIG. 26 is a view for describing a card removal amount in the connector illustrated in FIG. 25.
Figure 27A:
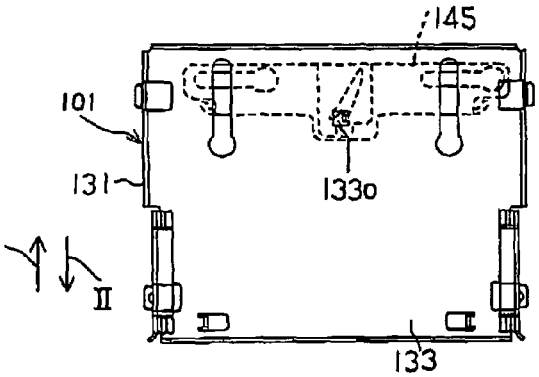
FIGS. 27A to 27D are views for describing an operation of the connector illustrated in FIG. 21.
Figure 27B:
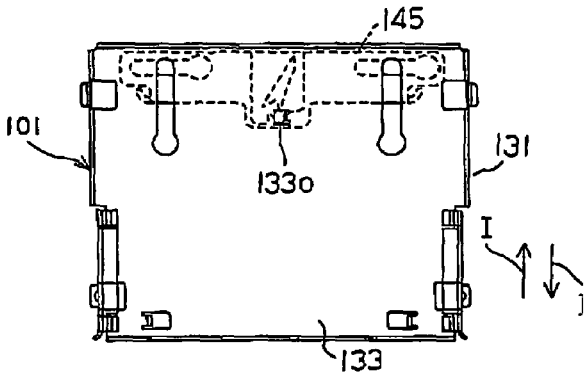
Figure 27C:
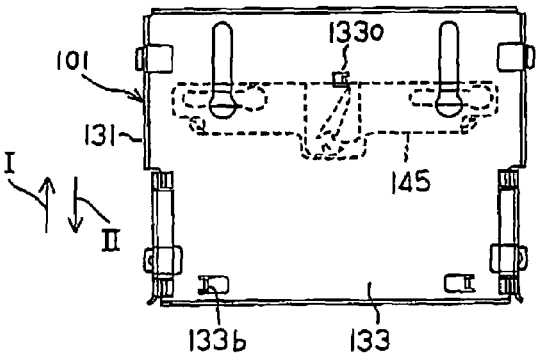
Figure 27D:
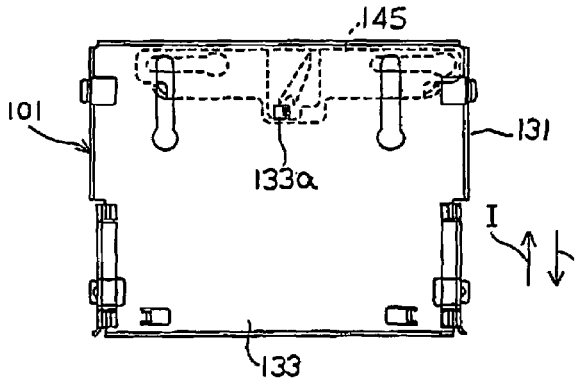

As illustrated in FIG. 26, when the card 151 is removed from the connector 101, the card 151 has a removal amount P.

Figure 21:
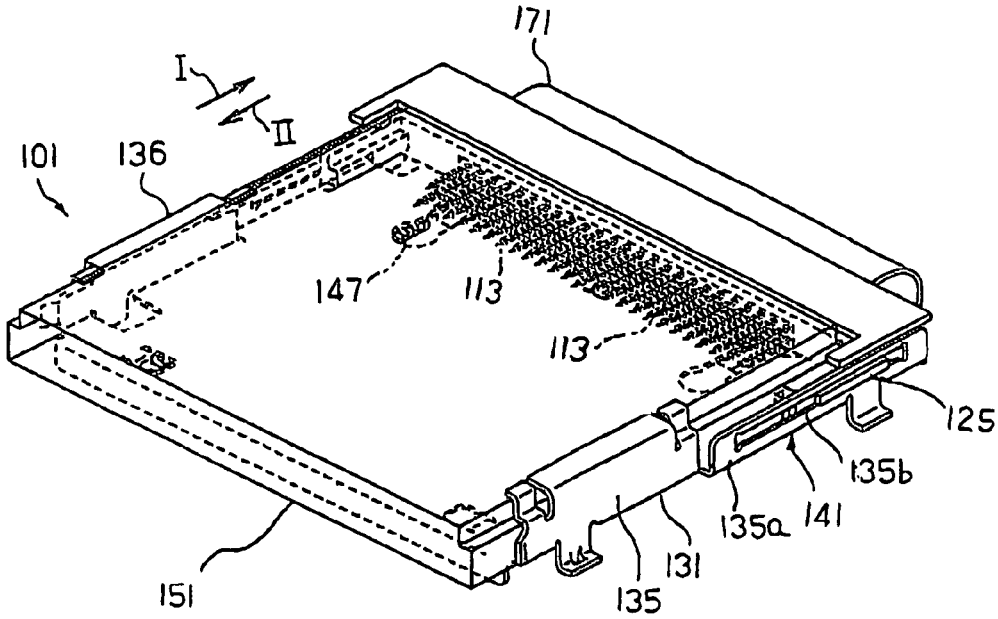
FIG. 21 is a perspective view of a connector according to a third embodiment of this invention.
Figure 22:
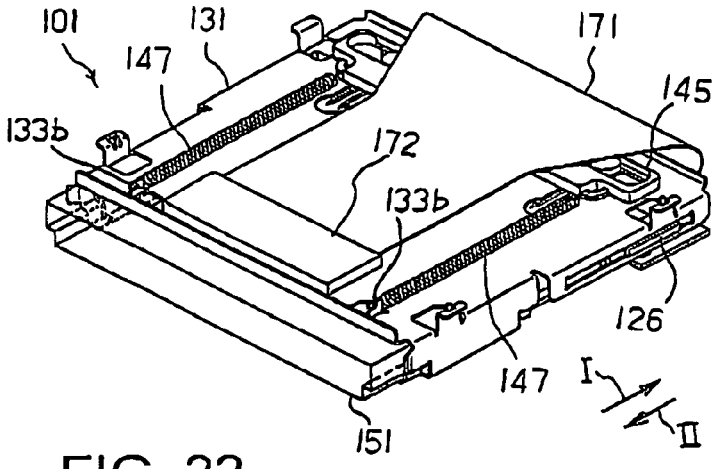
FIG. 22 is a bottom perspective view of the connector illustrated in FIG. 21.
Figure 23:
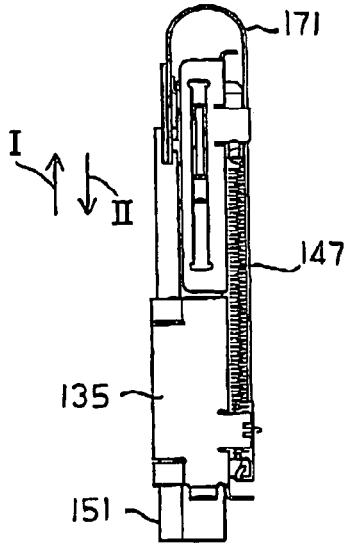
FIG. 23 is a side view of the connector illustrated in FIG. 21.
Figure 24:
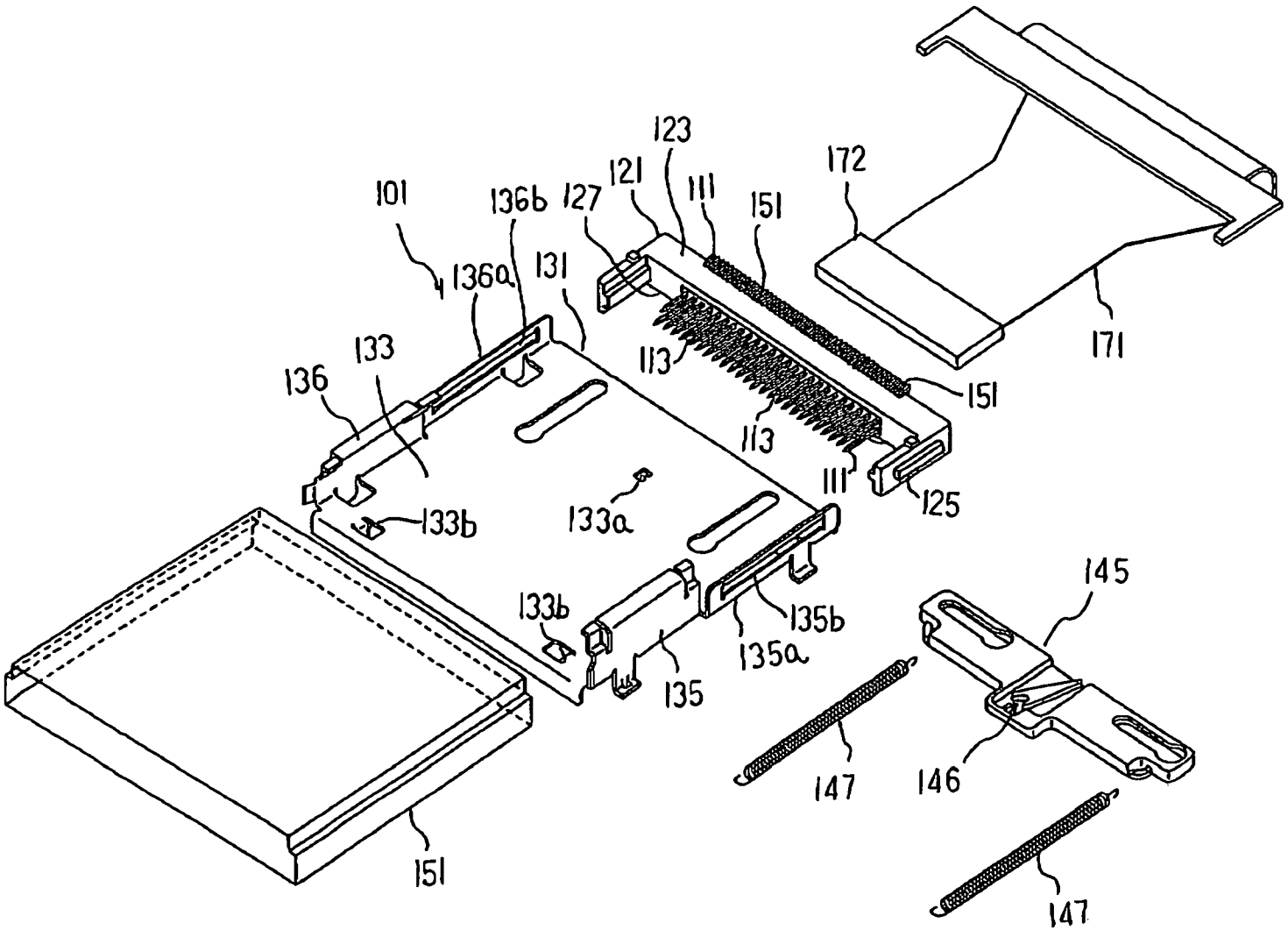
FIG. 24 is an exploded perspective view of the connector illustrated in FIG. 21.
Figure 25:
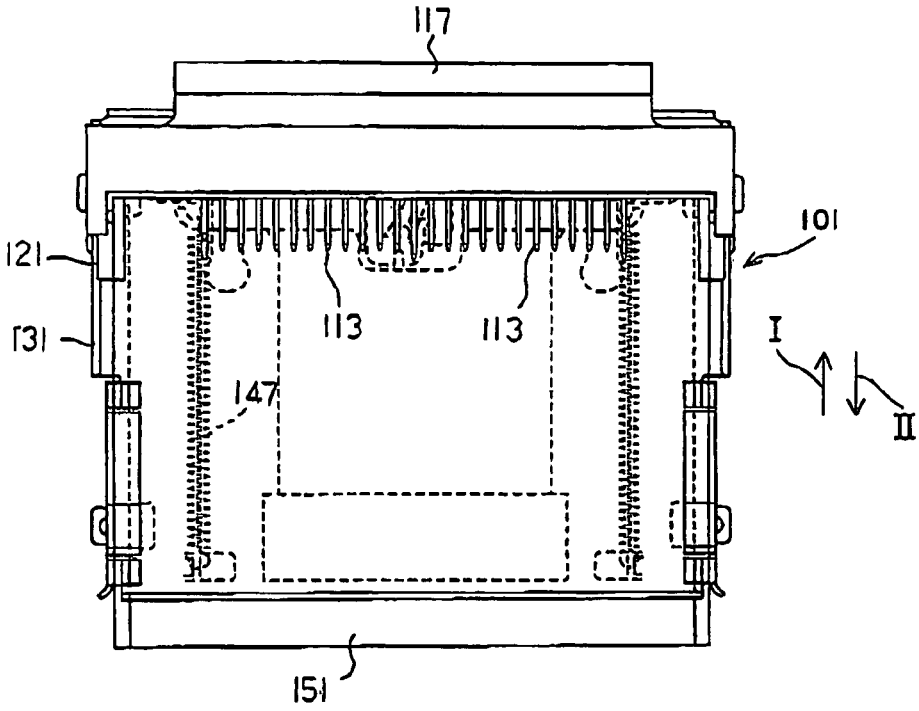
FIG. 25 is a plan view of the connector illustrated in FIG. 21.

Referring to FIGS. 27A to 27D, an operation of the connector 101 illustrated in FIG. 21 will be described.

FIGS. 27A, 27B, 27C, and 27D show a card initial position, a state where the card 151 is pushed inward, a state where the card 151 is removed, and a state where the card 151 is inserted, respectively.

The cam member 145 is movable horizontally with respect to the connector 101. The cam member 145 is continuously urged by the coil springs 147 to return to the center. The connector 101 is continuously subjected to a force by the coil springs 147 in the removing direction II. The cam member 145 follows the movement of the card 151 in the inserting and the removing directions I and II. The position of the cam member 145 in the inserting and the removing directions I and II is restricted by the cam protrusion 146.

With the above-mentioned connector, the connection object and the connection element are integrally moved when the connection object is inserted and removed. Therefore, it is possible to miniaturize the connector. In addition, unnecessary friction is not produced between the connection object and the contacts. Therefore, the coil spring 147 can be designed to exert a small force and the connector can be operated with a small operating force.

The above-mentioned connector may be used as a connector mounted to an electronic apparatus such as a PDA (personal digital assistant), a mobile telephone, a fixed telephone, a portable audio apparatus, and a camera to connect a card such as a SD memory card, a multimedia card (MMC), and an IC memory card containing an IC memory.

While the present invention has thus far been described in connection with a few embodiments thereof, it will readily be possible for those skilled in the art to put this invention into practice in various other manners. For example, the connector may have only one contact although the connector illustrated in the figures has a number of contacts.

What is claimed is:

1. A connector mountable on a board which includes a conductive portion, the connector comprising:

a guiding member which guides movement of a connection object in a fitting direction and a removing direction opposite to the fitting direction;

a connection element coupled to the guiding member and connectable to the connection object with movement of the connection object towards the fitting direction; and an ejecting mechanism coupled to the guiding member to give the connection object a moving force towards the removing direction in response to the movement towards the fitting direction of the connection object;

wherein the connection element comprises: (i) a base member coupled with the guiding member to be movable in a first range in the fitting and the removing directions, and (ii) a conductive contact held by the base member; and wherein the conductive contact comprises a first contacting portion connectable to the connection object, and a second contacting portion slidably contactable with the conductive portion when the connector is mounted on the board.

2. The connector according to claim 1, wherein the guiding member comprises a sliding groove extending in the fitting and the removing directions and defining the first range, and the base member comprises a sliding portion slidably inserted into the sliding groove.

3. The connector according to claim 1, wherein the ejecting mechanism comprises:

a slider coupled with the guiding member to be slidable in the fitting and the removing directions; and a cam mechanism connected to the guiding member for restricting movement of the slider in a second range in the fitting and the removing directions.

4. The connector according to claim 3, wherein the first range is longer than the second range.

5. The connector according to claim 4, wherein the ejecting mechanism further comprises a spring which is interposed between the slider and the guiding member, and which urges the slider in the removing direction.

6. The connector according to claim 3, wherein the first range is shorter than the second range.

7. The connector according to claim 6, wherein the ejecting mechanism further comprises a spring interposed between the slider and the guiding member, and which urges the slider in the removing direction to remove the connection object from the connection element.

8. The connector according to claim 1, wherein the ejecting mechanism comprises a slider coupled with the guiding member to be slidable in the fitting and the removing directions, and wherein the ejecting mechanism restricts movement of the slider in a second range in the fitting and the removing directions.

9. The connector according to claim 8, wherein the first range is longer than the second range in the removing direction.

10. The connector according to claim 8, wherein the second range is longer than the first range in the removing direction.

11. A connector mountable on a board which includes a conductive portion, the connector comprising:

a guiding member which guides movement of a connection object in a fitting direction and a removing direction opposite to the fitting direction;

a connection element coupled to the guiding member and connectable to the connection object with movement of the connection object towards the fitting direction; and an ejecting mechanism coupled to the guiding member to give the connection object a moving force towards the removing direction in response to the movement towards the fitting direction of the connection object;

wherein the connection element comprises:

a first base member coupled with the guiding member to be movable in a first range in the fitting and the removing directions;

a first conductive contact held by the first base member and connectable to the connection object;

a second base member coupled to the first base member; and a second conductive contact held by the second base member and connected to the conductive portion;

wherein the first and the second conductive contacts are in elastic contact with each other in the fitting and the removing directions.

12. The connector according to claim 11, wherein the guiding member comprises a sliding groove extending in the fitting and the removing directions and defining the first range, and the first base member comprises a sliding portion slidably inserted into the sliding groove.

13. The connector according to claim 11, wherein the ejecting mechanism comprises:

a slider coupled with the guiding member to be slidable in the fitting and the removing directions; and a cam mechanism connected to the guiding member for restricting movement of the slider in a second range in the fitting and the removing directions.

14. The connector according to claim 13, wherein the first range is longer than the second range.

15. The connector according to claim 14, wherein the ejecting mechanism further comprises a spring which is interposed between the slider and the guiding member, and which urges the slider in the removing direction.

16. The connector according to claim 13, wherein the first range is shorter than the second range.

17. The connector according to claim 16, wherein the ejecting mechanism further comprises a spring which is interposed between the slider and the guiding member, and which urges the slider in the removing direction to remove the connection object from the connection element.

18. The connector according to claim 11, wherein the ejecting mechanism comprises a slider coupled with the guiding member to be slidable in the fitting and the removing directions, and wherein the ejecting mechanism restricts movement of the slider in a second range in the fitting and the removing directions.

19. The connector according to claim 18, wherein the first range is longer than the second range in the removing direction.

20. The connector according to claim 18, wherein the second range is longer than the first range in the removing direction.

* * * * *